US005333456A

United States Patent [19]

Bollinger

[11] Patent Number: 5,333,456

[45] Date of Patent: Aug. 2, 1994

[54] ENGINE EXHAUST GAS RECIRCULATION CONTROL MECHANISM

[75] Inventor: Steven R. Bollinger, Chesterfield, Mo.

[73] Assignee: Carter Automotive Company, Inc., Southfield, Mich.

[21] Appl. No.: 955,072

[22] Filed: Oct. 1, 1992

[51] Int. Cl.[5] ..... F02M 25/07

[52] U.S. Cl. ..... 60/605.2; 123/568

[58] Field of Search ..... 60/605.2; 123/568

[56] References Cited

U.S. PATENT DOCUMENTS

| | | | |
|---|---|---|---|
| 3,996,748 | 12/1976 | Melchior | 60/605.2 |
| 4,020,809 | 5/1977 | Kern et al. . | |
| 4,090,482 | 5/1978 | Yoshida . | |
| 4,157,081 | 6/1979 | Wake et al. . | |
| 4,349,004 | 9/1982 | Matsuda . | |
| 4,354,476 | 10/1982 | Straubel . | |
| 4,359,033 | 11/1982 | Furuya et al. . | |
| 4,398,525 | 8/1983 | Ahrns et al. . | |
| 4,416,243 | 11/1983 | Naito et al. . | |
| 4,422,431 | 12/1983 | Dozono et al. . | |
| 4,440,139 | 4/1984 | Naito et al. . | |
| 4,474,008 | 10/1984 | Sakurai et al. . | |
| 4,484,445 | 11/1984 | Gillbrand . | |
| 4,895,125 | 1/1990 | Geiger | 123/568 |

FOREIGN PATENT DOCUMENTS

| | | | |
|---|---|---|---|
| 132615 | 11/1978 | Japan | 123/568 |
| 71233 | 6/1979 | Japan | 123/568 |
| 422861 | 4/1974 | U.S.S.R. | 60/605.2 |

*Primary Examiner*—Michael Koczo
*Attorney, Agent, or Firm*—Lawrence J. Shuruopoff

[57] ABSTRACT

A turbocharged or supercharged engine is provided with a vacuum actuated control device for an exhaust gas recirculation valve. A venturi throat in the engine air intake passage generates a vacuum in response to air flow through the throat. The vacuum is varied according to variations in the air flow rate throughout the throat, such that the vacuum can be applied to a piston for adjusting the position of a metering valve in an exhaust gas recirculation passage. The vacuum controlled valve enables the gas recirculation rate to be varied as a function of the air flow rate through the engine air intake passage.

16 Claims, 3 Drawing Sheets

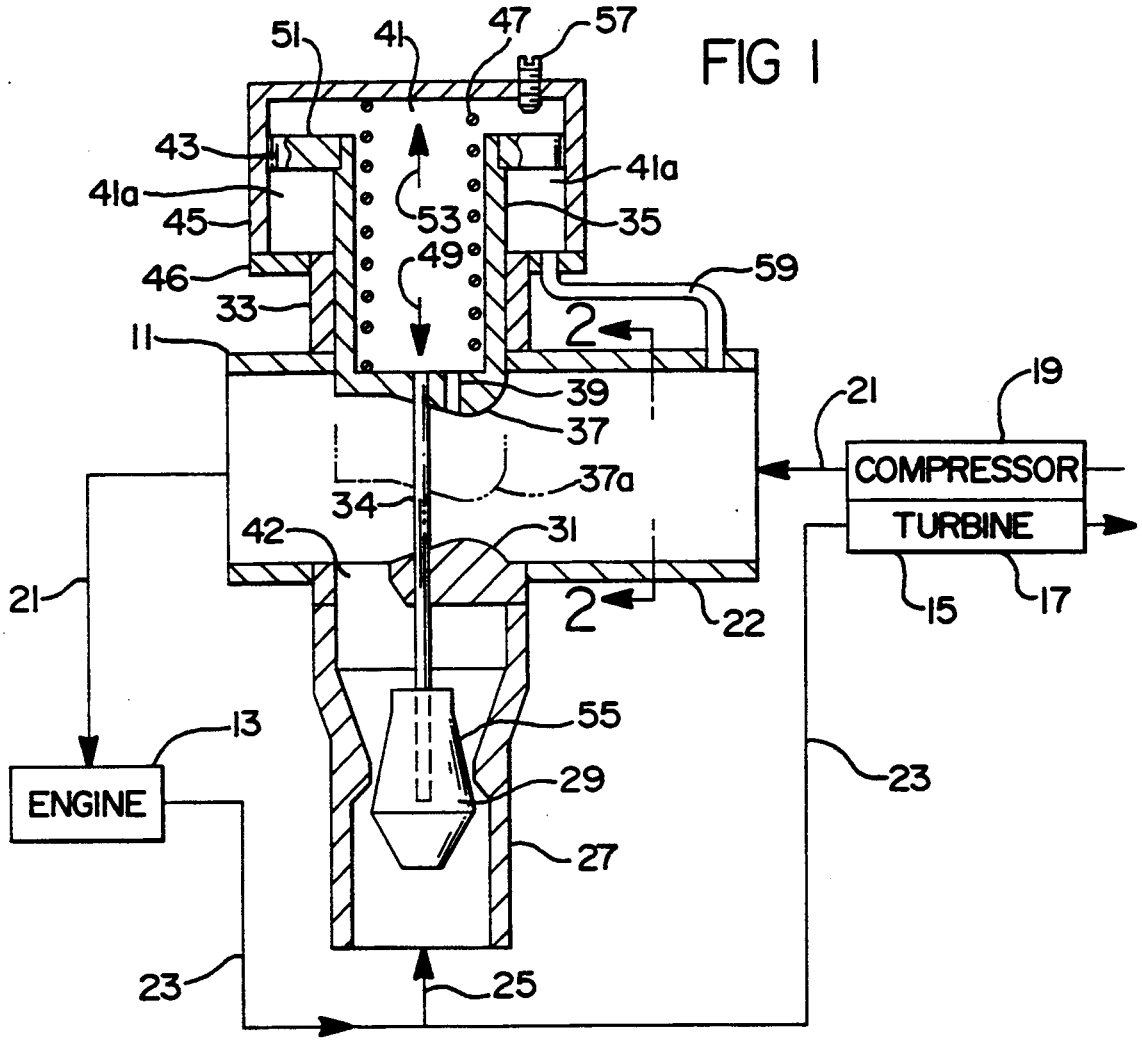
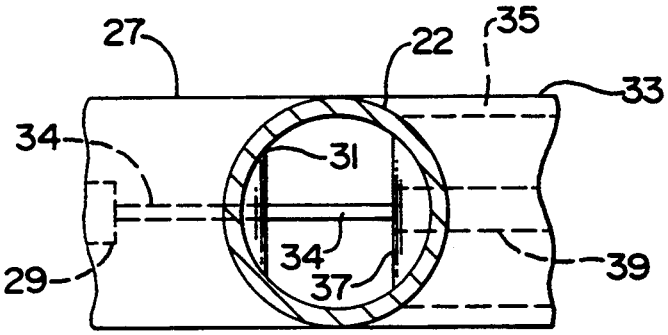
FIG 2

FIG 3
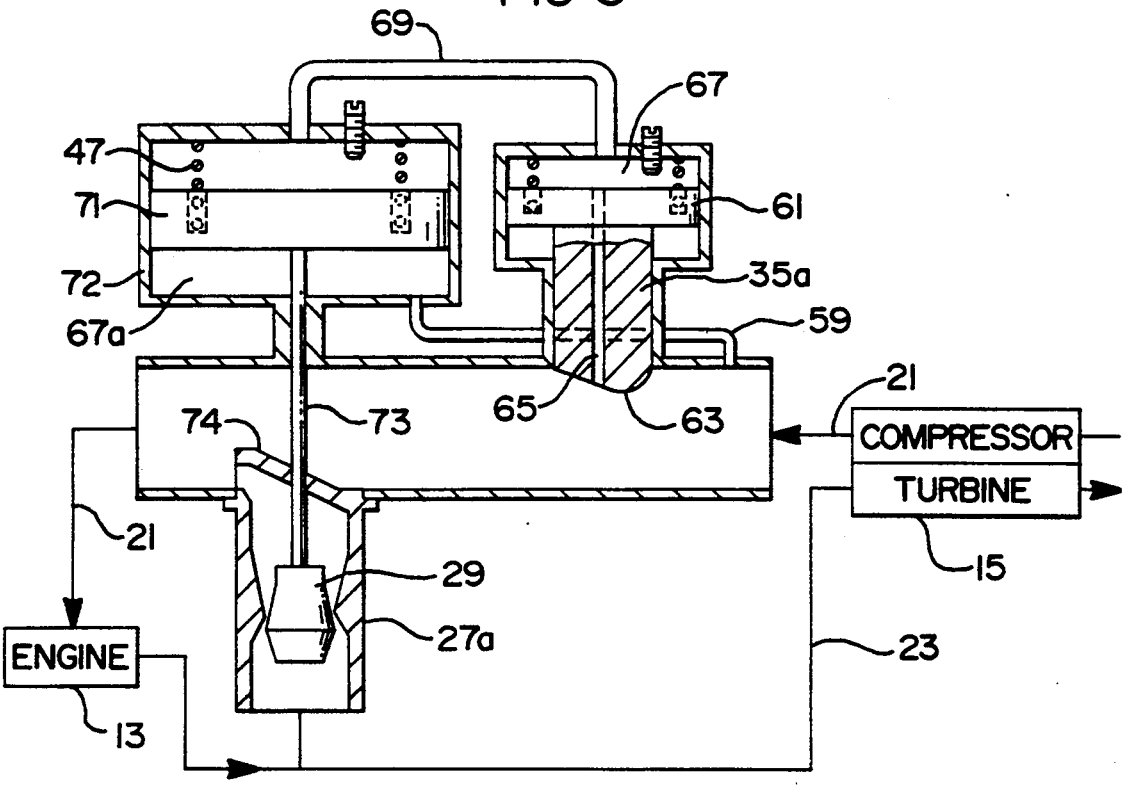
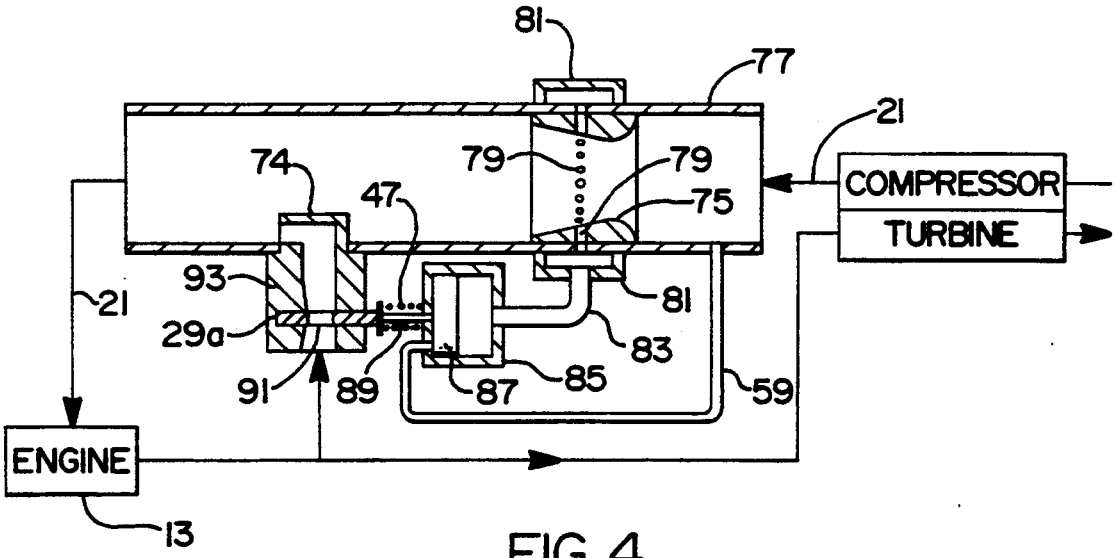
FIG 4

ENGINE EXHAUST GAS RECIRCULATION CONTROL MECHANISM

BACKGROUND OF THE INVENTION

1. Field of the Invention

This invention relates to exhaust gas recirculation (EGR) systems for internal combustion engines and especially to an EGR valve for turbocharged or supercharged diesel engines.

2. Description of Prior Developments

It is well known to recirculate engine exhaust gas for supplemental combustion in order to reduce the level of pollutants exhausted into the atmosphere. In spark-ignition engines, the air intake passage of the engine is typically at a subatmospheric pressure during engine operation. The subatmospheric pressure is often used for actuating an exhaust gas recirculation valve. This practice is well understood and documented in the prior art.

In turbocharged or supercharged engines, the air intake passage is typically above atmospheric pressure due to the air compressing action of the turbocharger or supercharger compressor on the intake air. Although the exhaust gas recirculation valve can be operated with a pressure differential between the air intake passage and the exhaust gas passage, valve operation is difficult or ineffective during times when the intake air passage pressure exceeds the exhaust gas pressure. In particular, the higher pressure of the intake air prevents the lower pressure exhaust gas from entering the intake air passage.

An example of a known EGR system is disclosed in U.S. Pat. No. 4,484,445 to Gillbrand. A super-charged engine includes a driver-operated throttle valve located in the air intake passage to generate air flow in two control lines connected to the passage at closely spaced points upstream from the valve. As the valve opens and closes, the pressures at the points where the control lines connect to the passage vary so that a pressure differential is established between the two control lines.

The respective lines are connected to opposite sides of a diaphragm-type actuator for a gas recirculation valve, such that the valve can be opened or closed by the pressure differential across the two lines. This approach is inappropriate for a compression ignition (diesel) engine since there is no throttle valve in the diesel system.

SUMMARY OF THE INVENTION

The present invention is directed to an exhaust gas recirculation system for a turbocharged or supercharged engine wherein a venturi throat is provided in the engine air intake passage. The venturi throat generates a vacuum related to and as a function of the localized gas flow rate across the throat. This mechanism for generating a vacuum is advantageous in that the magnitude of the vacuum can vary appreciably and in direct relation to the air flow rate to produce a variable and continuous actuation force for operating an EGR valve with minimal effect on the intake air flow.

The venturi generated vacuum is applied to a piston having a mechanical connection to a metering valve in the exhaust gas recirculation passage. The metering valve can thus be continuously moved back and forth by the variable vacuum force to adjust or vary the exhaust gas flow rate through the recirculation passage. The exhaust gas recirculation flow rate can be varied relatively smoothly as a function of the air intake flow rate.

A particular advantage of the present invention is that it operates without throttling or decreasing the air flow in the intake passage, and without the need for external pressure forces or power devices such as vacuum pumps. In a preferred practice of the invention, the venturi throat and metering valve are constructed as a unitary self-contained assembly installable as a single unit on an engine.

The aforementioned objects, features and advantages of the invention will, in part, be pointed out with particularity, and will, in part, become obvious from the following more detailed description of the invention, taken in conjunction with the accompanying drawings, which form an integral part thereof.

BRIEF DESCRIPTION OF THE DRAWINGS

In The Drawings:

FIG. 1 is a sectional view through a gas recirculation control device embodying features of the invention. The engine and supercharger are shown in block form;

FIG. 2 is a sectional view taken along line 2—2 in FIG. 1;

FIGS. 3 and 4 are views taken in the same direction as FIG. 1, but illustrating other forms that the invention can take;

In the various figures of the drawing, like reference characters designate like parts.

DETAILED DESCRIPTION OF THE PREFERRED EMBODIMENTS

Figure 5:
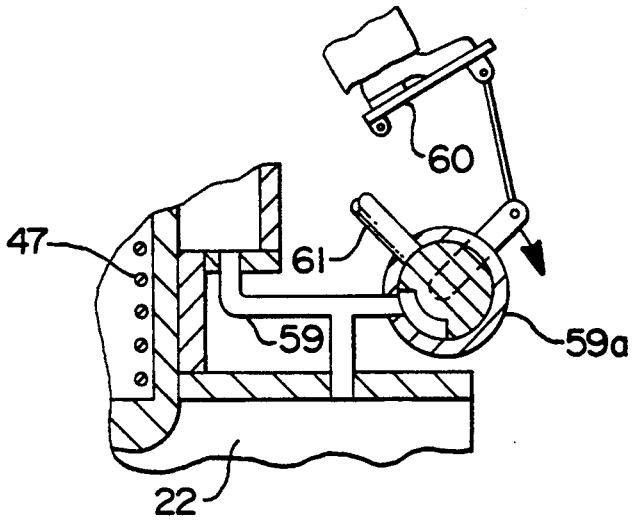
FIGS. 5 and 6 are fragmentary sectional views taken in the same direction as FIG. 1, but illustrating variations of the invention having a pressure control valve therein.

Referring to FIGS. 1 and 2, there is shown a gas recirculation control device 11 in conjunction with an engine 13 and a turbocharger or supercharger 15. With a turbocharger, a turbine 17 is driven by the flow of exhaust gases from the engine and a compressor or blower 19 is driven mechanically by the turbine. In the case of a supercharger, the compressor 19 is driven directly by the engine crankshaft.

Ambient air flows through and is compressed by the compressor 19. This pressurized air is directed into an air intake passage 21 that includes a passage section 22 extending through control device 11. Combustion products are exhausted from the engine through an exhaust passage 23 that communicates with turbine 17. A gas recirculation passage 25 extends from the exhaust passage 23 into communication with air intake passage section 22 in control device 11 so that some of the exhaust gases can be recirculated back through the engine for air pollution control purposes. Gas recirculation passage 25 includes a passage section 27 extending within control device 11 for housing a metering valve 29.

As seen in FIG. 2, air intake passage section 22 may have a circular cross-section although a round or oval or any other suitable cross section may be used. One wall of the passage is contoured to form a stationary venturi throat surface 31. A tubular guide structure 33 extends perpendicularly from passage section 22 to form a guide for a movable slide element 35. As seen in FIG. 1, one end face of slide element 35 is contoured to form a second venturi throat surface 37. Venturi throat surfaces 31,37 define therebetween a variable area venturi.

A port or opening 39 is formed in venturi throat surface 37 downstream from the narrowest point in the throat. Port 39 forms a passage communicating between venturi throat surface 37 and space 41 for introducing a reduced pressure in the confined space or chamber 41 formed within slide element 35. As air flows through the venturi throat in a right-to-left direction, air is drawn from space 41 through port 39 into the flowing air stream, thereby causing space 41 to be under at least a partial vacuum relative to passage 22.

The magnitude of the vacuum force generated by air flow through port 39 is related to the air flow rate through the venturi throat. A higher flow rate in air intake passage 21 produces a greater vacuum force, and a lower flow rate in air intake passage 21 produces a lesser vacuum force in space 41.

Slide element 35 has one end connected to a cylindrical piston 43 that is movable in a cylindrical housing 45 that is attached to guide structure 33. A compression coil spring 47 extends within slide element 35 to bias the slide element and attached piston in the direction indicated by arrow 49. The spring action is opposed by the venturi generated vacuum force which acts on face 51 of the piston to move the piston and attached slide element in the opposite direction, indicated by arrow 53.

The aforementioned metering valve 29 is mechanically connected to slide element 35 by an elongated stem or rod 34 extending transversely across the air intake passage section 22. As slide element 35 moves back and forth, as indicated by arrows 49 and 53, the metering valve 29 moves to a similar extent thereby varying the gas flow rate through the gas recirculation passage 25.

Variation in the gas flow rate can be controlled by the contour of the annular side surface 55 on the metering valve 29. Different contours can be used on surface 55 to produce different relationships between the air intake flow rate in passage 21 and the gas recirculation flow rate in passage 25. Additionally, changes in spring 47 rate or fully opened or closed position stops can alter the control relationships.

In one form of the invention, the metering valve 29 fully closes the gas recirculation passage 25 when the air flow rate through air intake passage 21 is at a maximum value, i.e. when piston 43 abuts against the adjustable stop 57.

Passage section 27 of gas recirculation passage 25 connects to the air intake passage 21 via intake port 42 which is located at a point adjacent to and immediately downstream from contoured surface 31 of the venturi throat. This is for the purpose of assisting the flow of gas from passage section 27 into the air intake passage 21.

Air flow through the venturi throat produces a low pressure condition at intake port 42, i.e. the point where passage section 27 discharges gas into the air intake passage 21. Thus, even though the static air pressure in air intake passage 21 may at times exceed the static pressure in exhaust passage 23 due to turbocharging or supercharging, there will nevertheless be a localized pressure differential for inducing or promoting gas flow through recirculation passage 25 in the desired direction into air passage 21 at the junction of these two passages.

Cylindrical piston 43 has a larger effective face area than the face area of movable throat surface 37 in order to provide a sufficient vacuum operating force for moving the metering valve 29 in the desired manner. In FIG. 1, the piston-slide element assembly is shown in an intermediate position between its two limiting positions.

At high air flow rates through intake passage 21, piston 43 abuts against stop 57. At low air flow rates through intake passage 21, the movable assembly can move to a position where the piston abuts against end wall 46 of housing 45. In this position, the movable contoured surface 37 of the venturi throat will be in the phantom position 37*a*.

A pressure equalization line 59 is provided between cavity 41*a* and the air intake passage section 22. Motion of the piston-slide element assembly is thus affected by the relative force values of spring 47 and the difference in pressure between passage section 22 and the pressure at venturi throat surface 37 acting over the piston area 43.

Line 59 provides a reference pressure in chamber 41*a* equal to the static pressure at the inlet to the venturi throat. This provides a pressure balance across piston 43 which cancels out the effects of pressure variations upstream of the venturi throat. This provides for the actuation of the metering valve 29 as a substantially linear function of flow.

Slide element 35 functions as a mechanical control which is responsive to venturi vacuum-generated force for controlling the position of metering valve 29 and its flow metering action. As shown in FIG. 1, the metering valve 29 moves with piston 43 and with slide element 35. However, the slide element need not be mechanically connected to the metering valve.

FIG. 3 shows an arrangement wherein a slide element 35*a* is connected to a relatively small diameter piston 61. Contoured end surface 63 of the slide element forms a movable venturi throat surface. As raw air flows along venturi surface 63 in a right to left direction, air is drawn through a passage 65 in the slide element to provide a vacuum force in confined space 67. The vacuum force is applied through a line 69 to a larger piston 71 movably mounted in a stationary housing 72. Piston 71 is mechanically connected to metering valve 29 via a rod-like stem 73 that extends transversely across the air intake passage.

In order to minimize restrictions to the flow of gas from the recirculation passage section 27*a* into the air intake passage section 74, a small hood 74 may be provided at the discharge end of passage section 27*a*. The hood isolates the recirculating gas from the flowing air stream until the gas is flowing with the stream. Velocity pressure of the stream is then in a direction for promoting gas flow into the stream. The operation of the system shown in FIG. 3 is generally similar to the operation of the previously described system shown in FIGS. 1 and 2.

FIG. 4 shows another form that the invention can take. In this case, the venturi throat is an annular insert element 75 fixedly mounted in the air intake passage section 77. A ring of ports 79 communicates the venturi throat with a manifold 81 surrounding passage section 77.

A fluid line 83 connects manifold 81 to a stationary housing 85 containing a movable piston 87. Air flowing through the venturi throat creates a vacuum force in line 83 so that piston 87 is drawn rightwardly in housing 85. The piston has a piston rod 89 that connects with a slidable plate-type metering valve 29*a*.

The metering valve has a through opening 91 that has varying degrees of registry with the flow passage section 93, depending on the position of piston 87 in housing 85. A spring 47 is trained between housing 85 and a stop shoulder on rod 89 to oppose the vacuum force on piston 87.

Metering valve 29a is constructed differently than the metering valves shown in FIGS. 1 and 3. However, the respective metering valves have the same overall function in the system, i.e. to adjust or vary the gas flow rate through the recirculation passage in accordance with variations in air flow rate through the engine air intake passage. Opening 91 in metering valve 29a can have varying dimensions normal to the plane of the paper in FIG. 4, whereby different relationships can be achieved between the air flow rate and recirculating gas flow rate. Any suitable valve geometry would apply.

FIG. 1 represents a preferred form of the invention. FIGS. 3 and 4 represent other constructions that can be employed in extended practice of the invention.

Additional or supplemental control of the movement of the venturi throat and of the amount of exhaust gas recirculated may be implemented through the addition of control valves which affect the relative pressures in chambers 41 and 41a. Such control adds a non-linear component to the relationship between the flow through the venturi throat and the displacement of valve 29. An example is shown in FIG. 5 wherein a valve 59a connects the passage 59 to atmosphere, or some other pressure reference via an outlet port 61.

Figure 6:
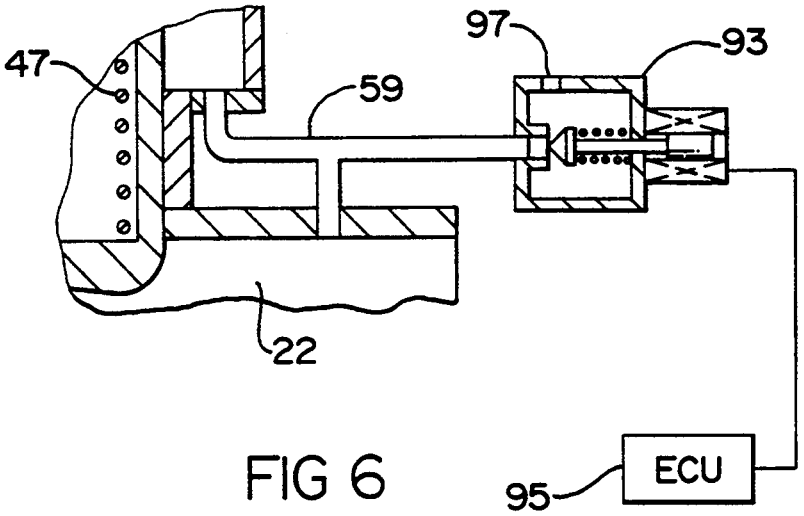

Valve 59a could be mechanically controlled by the position of accelerator 60 as shown in FIG. 5, or by an electronic or solenoid-actuated valve 93 controlled by a computer such as engine control unit 95 shown in FIG. 6. Valve 93, which may be a pulse width modulated solenoid valve, vents line 59 to atmosphere via vent 97. At a fully open throttle position, vent 59 may be fully open to the atmosphere.

Obviously, numerous modifications and variations of the present invention are possible in the light of the above teachings. It is therefore to be understood that within the scope of the appended claims, the invention may be practiced otherwise than as specifically described herein.

What is claimed is:

1. An exhaust gas recirculation system for an engine having an air intake passage adapted to receive pressurized air from a compressor and an exhaust gas recirculation passage connected to said air intake passage, said system comprising:

a movable venturi throat disposed in said air intake passage for generating a reduced pressure as a function of intake air flow rate through said throat while minimizing restriction to air flow;

a metering valve disposed in said exhaust gas recirculation passage; and control means operated by said reduced pressure generated by said movable venturi throat for actuating said metering valve.

2. The system of claim 1, wherein said control means comprises a movable contoured surface forming a wall portion of said venturi throat.

3. The system of claim 2, wherein said control means comprises a stem extending from said movable contoured surface across said venturi throat.

4. The system of claim 3, wherein said venturi throat comprises a stationary contoured surface in opposed relation to said movable contoured surface.

5. The system of claim 4, wherein said movable contoured surface on said control means is movable transversely across said air intake passage toward or away from said second stationary contoured surface.

6. The system of claim 5, wherein said stem extends through said stationary contoured surface of the venturi throat.

7. The system of claim 2, wherein said control means comprises a piston, and said movable contoured surface comprises a flow sensing port formed therein for drawing air from the piston into and through the venturi throat.

8. The system of claim 7, and further comprising spring means connected to said control means for moving said control means in a direction to reduce the area of the venturi throat.

9. The system of claim 7, wherein said control means comprises a movable slide element slidably supported for motion transverse to said air intake passage; said movable contoured surface being located at one end of said slide element within the air intake passage; said piston being located at the other end of said slide element remote from said air intake passage.

10. The system of claim 9, wherein said piston has one face exposed to a reduced pressure communicated from said flow sensing port; said one face of said piston having a greater area than said area of the movable contoured surface.

11. The system of claim 1, wherein said gas recirculation passage is connected to said air intake passage at a point immediately downstream from said venturi throat, whereby air flowing out of said throat promotes the flow of gas from said recirculation passage into said air intake passage.

12. The system of claim 1, wherein said control means comprises a piston separated from the venturi throat, and a pressure-sensing line extending from a point adjacent said venturi throat to said piston.

13. The system of claim 1, wherein said control means comprises a supplemental valve in fluid communication with said metering valve and with atmosphere for controlling movement of said movable venturi throat.

14. The system of claim 13, wherein said supplemental valve comprises a vent line communicating with atmosphere pressure.

15. An exhaust gas recirculation system for an engine having an air intake passage adapted to receive pressurized air from a compressor and communicating with an exhaust gas recirculation passage at a fluid junction with an intake port, said system comprising:

flow-restricting means comprising a variable area venturi having a movable portion connected to said valve means for actuating and controlling said valve means provided in said air intake passage for generating a pressure drop in intake air flowing therethrough, said flow restricting means being disposed adjacent said junction such that exhaust gas within said recirculation passage is induced to flow through said intake port and into said intake passage at said pressure drop; and valve means disposed in said recirculation passage for metering said exhaust gas through said intake port.

16. The system of claim 15, further comprising supplemental vent valve means in fluid communication with said valve means and with atmosphere for selectively controlling operation of said valve means by communicating said valve means with atmosphere.

* * * * *